US010364785B2

(12) United States Patent
Sano et al.

(10) Patent No.: US 10,364,785 B2
(45) Date of Patent: Jul. 30, 2019

(54) FUEL INJECTION NOZZLE

(71) Applicant: DENSO CORPORATION, Kariya, Aichi-pref. (JP)

(72) Inventors: Shinya Sano, Kariya (JP); Kazufumi Serizawa, Kariya (JP); Atsushi Utsunomiya, Kariya (JP); Toshiaki Hijima, Nishio (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/738,278

(22) PCT Filed: Jun. 8, 2016

(86) PCT No.: PCT/JP2016/002773
§ 371 (c)(1),
(2) Date: Dec. 20, 2017

(87) PCT Pub. No.: WO2016/208138
PCT Pub. Date: Dec. 29, 2016

(65) Prior Publication Data

US 2018/0180009 A1 Jun. 28, 2018

(30) Foreign Application Priority Data

Jun. 24, 2015 (JP) ..... 2015-126865

(51) Int. Cl.
*F02M 61/18* (2006.01)

(52) U.S. Cl.
CPC .... *F02M 61/1893* (2013.01); *F02M 61/1806* (2013.01); *F02M 61/1833* (2013.01);
(Continued)

(58) Field of Classification Search
CPC ..... F02M 61/1893; F02M 61/1806; F02M 61/1833; F02M 61/1886; F02M 61/1826; F02M 61/1846
(Continued)

(56) References Cited

U.S. PATENT DOCUMENTS 4,721,253 A * 1/1988 Noguchi ..... B05B 1/3405 239/464
5,649,665 A * 7/1997 El-Darazi ..... F02M 61/18 239/533.12
(Continued)

FOREIGN PATENT DOCUMENTS

EP 2 239 452 10/2010
JP 2010-174819 8/2010

OTHER PUBLICATIONS

International Search Report for PCT/JP2016/002773, dated Jul. 26, 2016, 4 pages.

*Primary Examiner* — Arthur O. Hall
*Assistant Examiner* — Joseph A Greenlund
(74) *Attorney, Agent, or Firm* — Nixon & Vanderhye P.C.

(57) ABSTRACT

A throttle portion is defined between an upper end of a sac chamber and a conical portion of a needle to have a throttle opening area S1. Half of an area surrounded by the throttle portion, the needle, an inner wall of the sac chamber, and a lower end extended line in a cross section of the sac chamber taken along a sac center line is an injection hole upstream area S2. A lift amount, when the throttle opening area S1 is equal to an area which is calculated by multiplying an injection hole area S3 by the number of the injection holes, is a predetermined lift amount L. A viscosity coefficient of fuel is ρ. An index value Sa, which is calculated in accordance with an equation as below, is set to 0.5 or greater.
(Continued)

$$S_a = \frac{\rho}{2}\int_{h=0}^{h=L}\left(\frac{S_1}{S_2 - S_1}\right)^2 dh$$

3 Claims, 5 Drawing Sheets

(52) U.S. Cl.
CPC ..... *F02M 61/1826* (2013.01); *F02M 61/1846* (2013.01); *F02M 61/1886* (2013.01)

(58) Field of Classification Search
USPC ..... 239/533.12
See application file for complete search history.

(56) References Cited

U.S. PATENT DOCUMENTS 6,173,912 B1 * 1/2001 Gottlieb ..... F02M 61/08 239/533.12
6,322,007 B1 11/2001 Potz et al.
6,758,407 B1 * 7/2004 Lambert ..... F02M 45/086 123/294
7,017,840 B2 3/2006 Krüger et al.
7,438,238 B2 * 10/2008 Date ..... F02M 43/04 123/304
7,510,129 B2 * 3/2009 Kuronita ..... F02M 61/182 239/556
8,544,770 B2 * 10/2013 Limmer ..... F02M 61/1806 123/525
8,708,256 B2 * 4/2014 Kobayashi ..... F02M 61/163 239/487
9,562,503 B2 * 2/2017 Hijima ..... F02M 61/10
2005/0120995 A1 * 6/2005 Tsujimoto ..... F02B 23/0669 123/299
2005/0161536 A1 * 7/2005 Tojo ..... F02M 61/12 239/584
2006/0081722 A1 * 4/2006 Kato ..... F02D 19/0694 239/96
2006/0249600 A1 * 11/2006 Sako ..... F02M 61/06 239/533.12
2009/0242670 A1 * 10/2009 Kato ..... F02M 51/0671 239/584
2010/0051727 A1 * 3/2010 Irino ..... F02M 61/1806 239/548
2011/0068188 A1 * 3/2011 Laimboeck ..... F02B 23/0669 239/5
2012/0152205 A1 * 6/2012 Matsumura ..... F02M 61/184 123/445
2013/0270369 A1 * 10/2013 Peters ..... F02M 61/1866 239/533.2
2016/0237937 A1 * 8/2016 Kusakabe ..... F02D 41/20

* cited by examiner (a)

(b)

FUEL INJECTION NOZZLE

CROSS REFERENCE TO RELATED APPLICATION

This application is the U.S. national phase of International Application No. PCT/JP2016/002773 filed Jun. 8, 2016, which designated the U.S. and claims priority to Japanese Patent Application No. 2015-126865 filed on Jun. 24, 2015, the entire contents of each of which are hereby incorporated herein by reference.

TECHNICAL FIELD

The present disclosure relates to a fuel injection nozzle for injecting fuel.

BACKGROUND ART

A fuel injection nozzle of a conical insertion type disclosed in, for example, Patent Literature 1 has a conical portion which is provided at a tip end of a needle and axially overlaps a sac chamber in a nozzle body.

PRIOR TECHNICAL LITERATURE

Patent Literature

Patent Literature 1: JP-A-2010-174819

Hereinafter, a description will be given on the assumption that a needle moves in an axial direction and moves upward to start fuel injection. In a low lift state where a lift amount of the needle is small immediately after an injection is started, a strong turbulence develops in a flow of fuel in a sac chamber. Such a turbulence may undesirably decrease a flow rate coefficient in the sac chamber, which is a measure of a rate at which fuel is introduced from the sac chamber into an injection hole. When a flow rate coefficient in the sac chamber becomes small, a spray penetration force becomes weak. The term, "a spray penetration force", referred to herein represents a force by which atomized fuel injected from the injection hole is carried far off. When a spray penetration force becomes weak, atomized fuel cannot be carried far off. When a lift amount increases, a flow of fuel flowing through the sac chamber changes with a variance in the lift amount. More specifically, fuel that has been flowing along the conical portion in the low lift state changes to flow along an inner wall of the sac chamber when the lift amount increases. For this reason, a flow of fuel in the sac chamber may become unstable.

SUMMARY OF INVENTION

It is an object of the present disclosure to produce a fuel injection nozzle of a conical insertion type capable of increasing a flow rate coefficient in a sac chamber and stabilizing a flow of fuel in the sac chamber.

Inventors of the present disclosure discovered that a flow of fuel in a sac chamber can be controlled by controlling a throttle opening area S1 and an injection hole upstream area S2. More specifically, inventors of the present disclosure discovered that Equation (1) as below using the throttle opening area and the injection hole upstream area is proportional to a flow rate coefficient in the sac chamber.

$$\text{flow rate coefficient in } sac \propto \frac{\rho}{2}\int_{h=0}^{h=L}\left(\frac{S_1}{S_2-S_1}\right)^2 dh \qquad \text{[Equation 1]}$$

Setting an index value Sa, which is calculated in accordance with Equation (1) above, to 0.5 or greater not only to enable to increase a flow rate coefficient in the sac chamber but also to enable to stabilize a flow of fuel in the sac chamber.

According to one aspect of the present disclosure, a fuel injection nozzle comprises a nozzle body 1 having a valve seat 5, which is in a conical shape and formed inside, a sac chamber 6, which is formed inside to collect pressurized fuel which has passed through an inside of the valve seat, and an injection hole 3 to inject pressurized fuel supplied to the sac chamber to an outside. The fuel injection nozzle further comprises a needle 2 having a seat portion 8, which is to cut off supply of pressurized fuel into the sac chamber when seated on the valve seat, and a conical portion 9, which is in a conical shape with a boundary at the seat portion, the conical portion being inserted inside the sac chamber, the needle being driven in a linear direction inside the nozzle body. The needle is to move in a direction upward when starting fuel injection. The needle is to move in a direction downward when stopping fuel injection. An upward movement amount of the needle is a lift amount. A direction along which the needle is to move is an axial direction h. An axial straight line passing a center of the sac chamber is a sac center line L1. An opening area of a throttle portion x defined between an upper end of the sac chamber and the conical portion is a throttle opening area S1. A straight line drawn by extending a center axis of the injection hole into the sac chamber is an injection hole extended line L2. A location where the injection hole opens in the sac chamber is an injection hole inlet 3*a*. A straight line passing a lower end of the injection hole inlet and parallel to the injection hole extended line is a lower end extended line L3. a half of an area surrounded by the throttle portion, the needle, an inner wall of the sac chamber, and the lower end extended line in a cross section of the sac chamber taken along the sac center line is an injection hole upstream area S2. A passage area of the injection hole is an injection area S3. A lift amount, when the throttle opening area is equal to an area calculated by multiplying the injection hole area by the number of the injection hole, is a predetermined lift amount L. A viscosity coefficient of fuel is a coefficient ρ. An index value Sa is calculated in accordance with an equation as below. The index value Sa satisfies an inequality of Sa≥0.5.

$$S_a = \frac{\rho}{2}\int_{h=0}^{h=L}\left(\frac{S_1}{S_2-S_1}\right)^2 dh \qquad \text{[Equation 2]}$$

BRIEF DESCRIPTION OF THE DRAWINGS

The above and other objects, features and advantages of the present disclosure will become more apparent from the following detailed description made with reference to the accompanying drawings. In the drawings.

The above and other objects, configurations, and advantages of the present disclosure will become more apparent from the following detailed description taken in conjunction with the accompanying drawings, in which.

DESCRIPTION OF EMBODIMENTS

Figure 1:
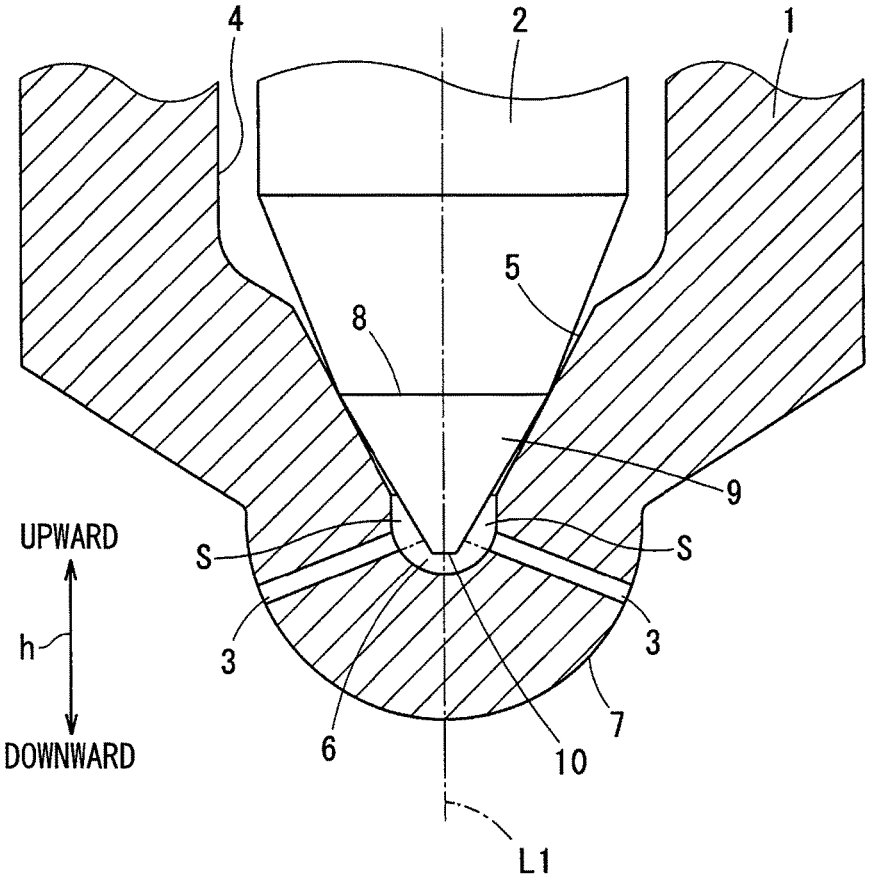
FIG. 1 is a sectional view of a major portion of a fuel injection nozzle along a sac center line.

Hereinafter, embodiments to carry out the present disclosure will be described according to the drawings. It should be appreciated that the embodiments described below are a mere example and the present disclosure is not limited to the embodiments below.

First Embodiment

A first embodiment will be described with reference to FIG. 1 to FIG. 5B. An engine mounted to an automobile includes a fuel injection device. A fuel injection device of the present embodiment is used for a diesel engine and includes a common rail to accumulate high-pressure fuel therein. In the fuel injection device, injectors to inject high-pressure fuel are of a direct injection type, which are mounted to respective cylinders of the engine and directly inject fuel into the mounted cylinders.

The injector includes a fuel injection nozzle. The fuel injection nozzle has a nozzle body 1 and a needle 2. The nozzle body 1 is supplied with pressurized fuel from the common rail. The needle 2 is driven linearly inside the nozzle body 1. Hereinafter, an amount of upward movement of the needle 2 is referred to as a lift amount, and a movement direction of the needle 2 is referred to as an axial direction h.

A driving system of the needle 2 is not limited to any particular system. Examples of an applicable driving system of the needle 2 include but not limited to an electromagnetic valve injector, a piezo injector, and an electromagnetically-driven injector. In the electromagnetic valve injector, the needle 2 is driven by a hydraulic pressure controlled by an electromagnetic valve. In the piezo injector, the needle 2 is driven by a hydraulic pressure controlled by a piezo actuator. In the electromagnetically-driven injector, the needle 2 is directly driven by an electromagnetic actuator.

The fuel injection nozzle will now be described specifically. A nozzle hole 4, a valve seat 5, and a sac chamber 6 are provided inside the nozzle body 1. High-pressure fuel is supplied to the nozzle hole 4. The valve seat 5 is of a conical shape. The sac chamber 6 is of a spherical surface shape, in which pressurized fuel which has passed through the inside of the valve seat 5 is collected. The valve seat 5 is formed at a lower end of the nozzle hole 4. A conical surface of the valve seat 5 is formed to become smaller in the diameter from upside to downside.

The sac chamber 6 is formed in a combination of a cylindrical surface 6*a* extending downward from a lower end of the valve seat 5 and a hemispherical surface 6*b* coupled to a lower end of the cylindrical surface 6*a*. More specifically, a swell portion 7 in a hemispherical shape exposed to a combustion chamber of the engine is provided to an outer surface of the nozzle body 1 at a lower end, and the sac chamber 6 is provided in the inside of the swell portion 7.

The nozzle body 1 is provided with one or more than one injection hole 3 from which pressurized fuel supplied to the sac chamber 6 is injected to an outside of the nozzle body 1. The following will describe a configuration where multiple injection holes 3 are formed as a specific example.

Each injection hole 3 is provided to penetrate through the swell portion 7 from the inside to the outside. More specifically, the injection hole 3 is a hole that diagonally penetrates from an inner wall surface of the sac chamber 6 to an outer wall surface of the swell portion 7, and drilled by cutting with a drill blade, by electro-spark machining, laser beam machining, or the like. FIG. 1 shows a configuration where the injection holes 3 are circular holes each having a constant diameter as an example. It should be appreciated, however, that a shape of the injection holes 3 is not limited to the shape shown in FIG. 1.

The needle 2 is in a shaft shape extending in an upside-downside direction. The needle 2 is supported to be driven in the upside-downside direction at a center of the nozzle hole 4. The needle 2 is provided with an annular seat portion 8. The seat portion 8 is seated on the valve seat 5 to cut off a supply of pressurized fuel into the sac chamber 6.

The seat portion 8 is formed at a boundary between two conical surfaces each having a different spread angle. More specifically, a spread angle of a conical surface above the seat portion 8 is smaller than a spread angle of the valve seat 5 whereas a spread angle of a conical surface below the seat portion 8 is greater than the spread angle of the valve seat 5. In the following description, a conical portion below the seat portion 8 is referred to as the conical portion 9. That is, the needle 2 is formed with the conical portion 9 in a conical shape that becomes smaller in the diameter from the seat portion 8 to the downside and is formed with the seat portion 8 located at the boundary.

Figure 2:
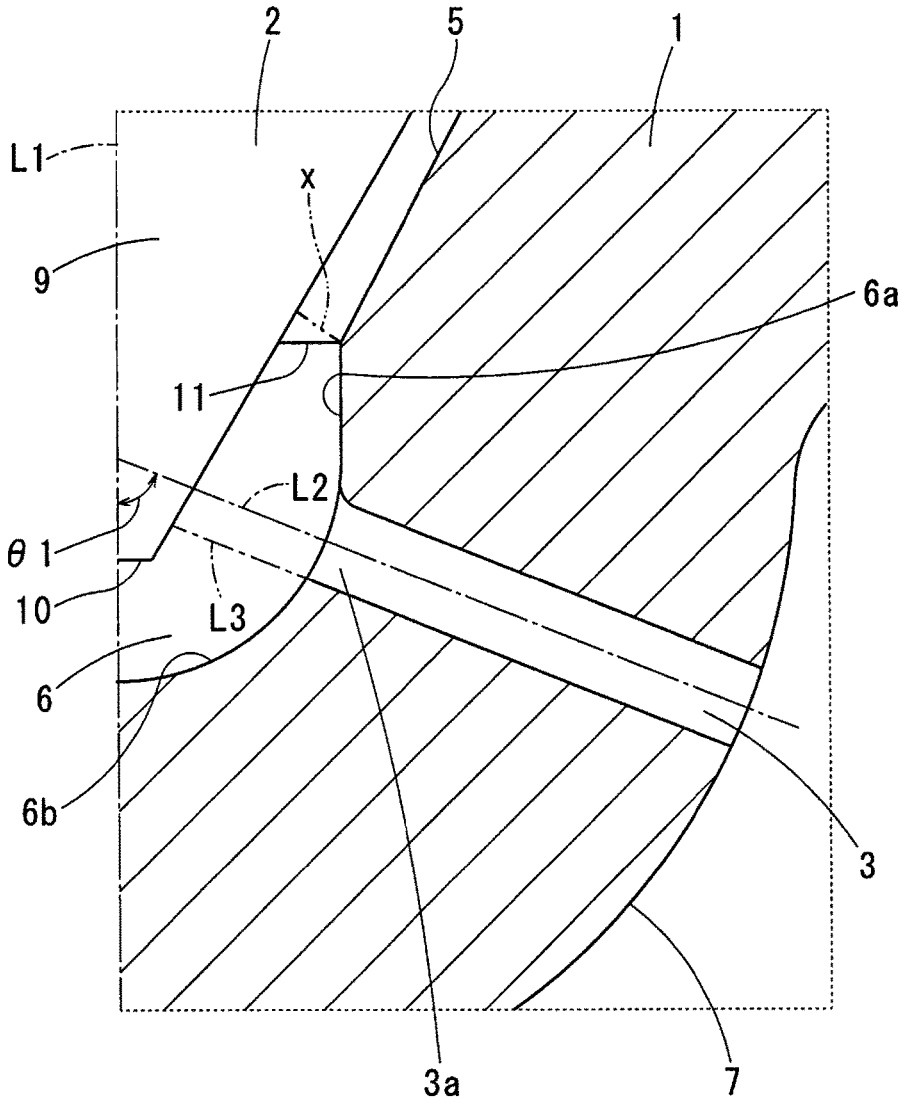
FIG. 2 is a view used to describe a major portion of the fuel injection nozzle.
Figure 3:
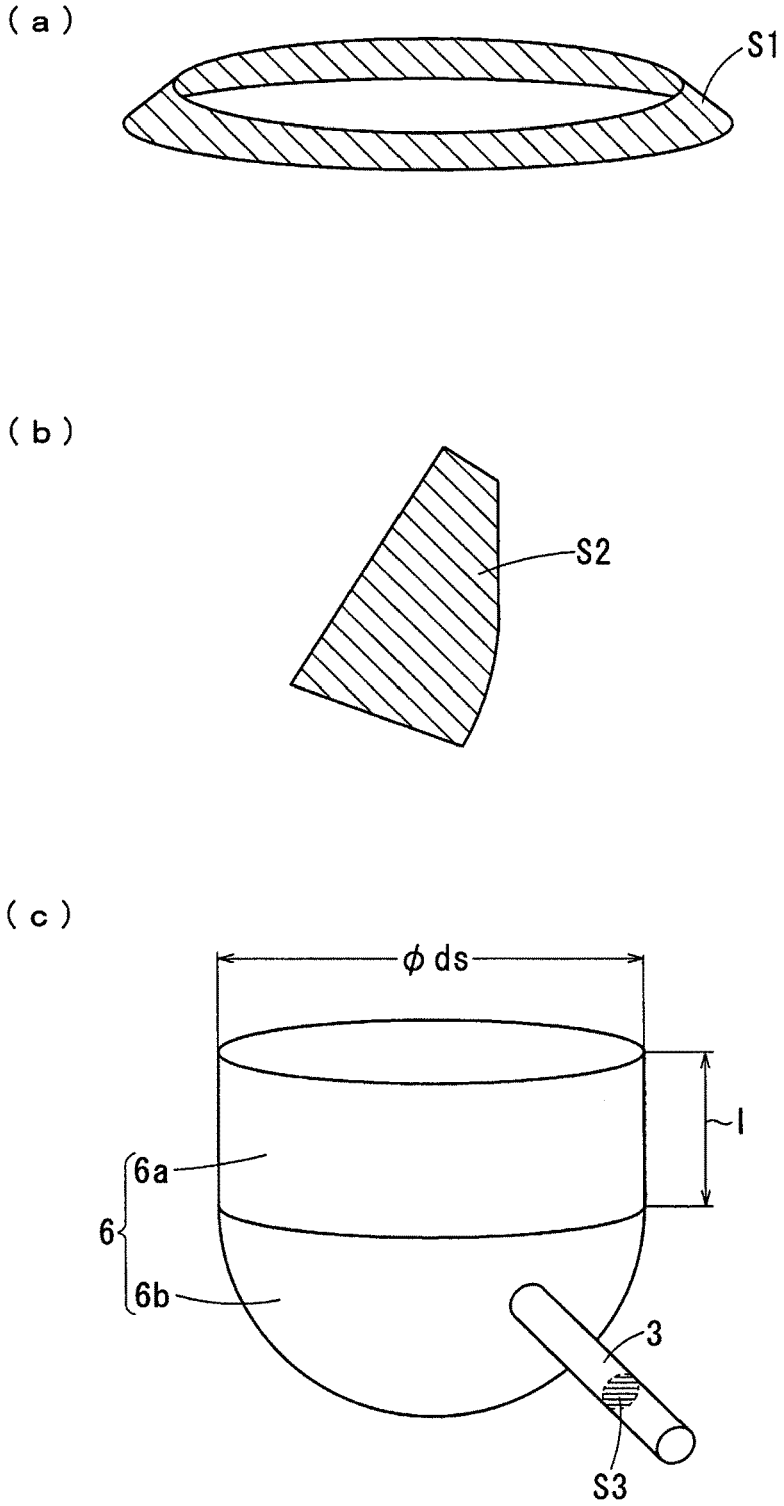
FIG. 3A is a view used to describe a throttle opening area.
FIG. 3B is a view used to describe an injection hole upstream area.
FIG. 3C is a view used to describe an injection hole area.
Figure 4:
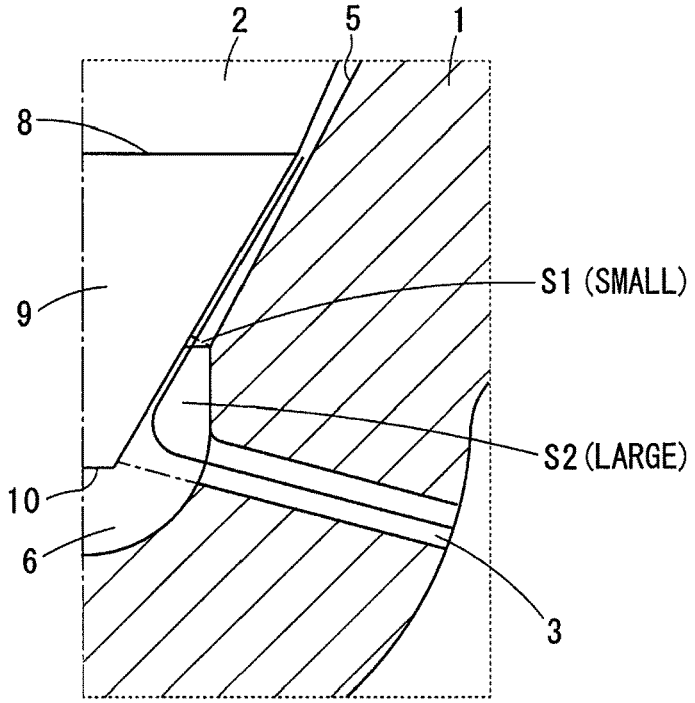
FIGS. 4A and 4B are views used to describe an operation when an index value Sa is less than 0.5.
Figure 4:
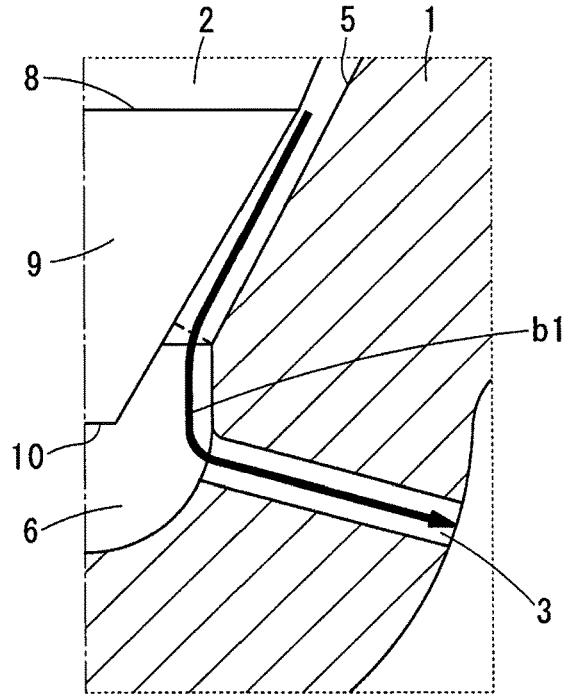
Figure 5:
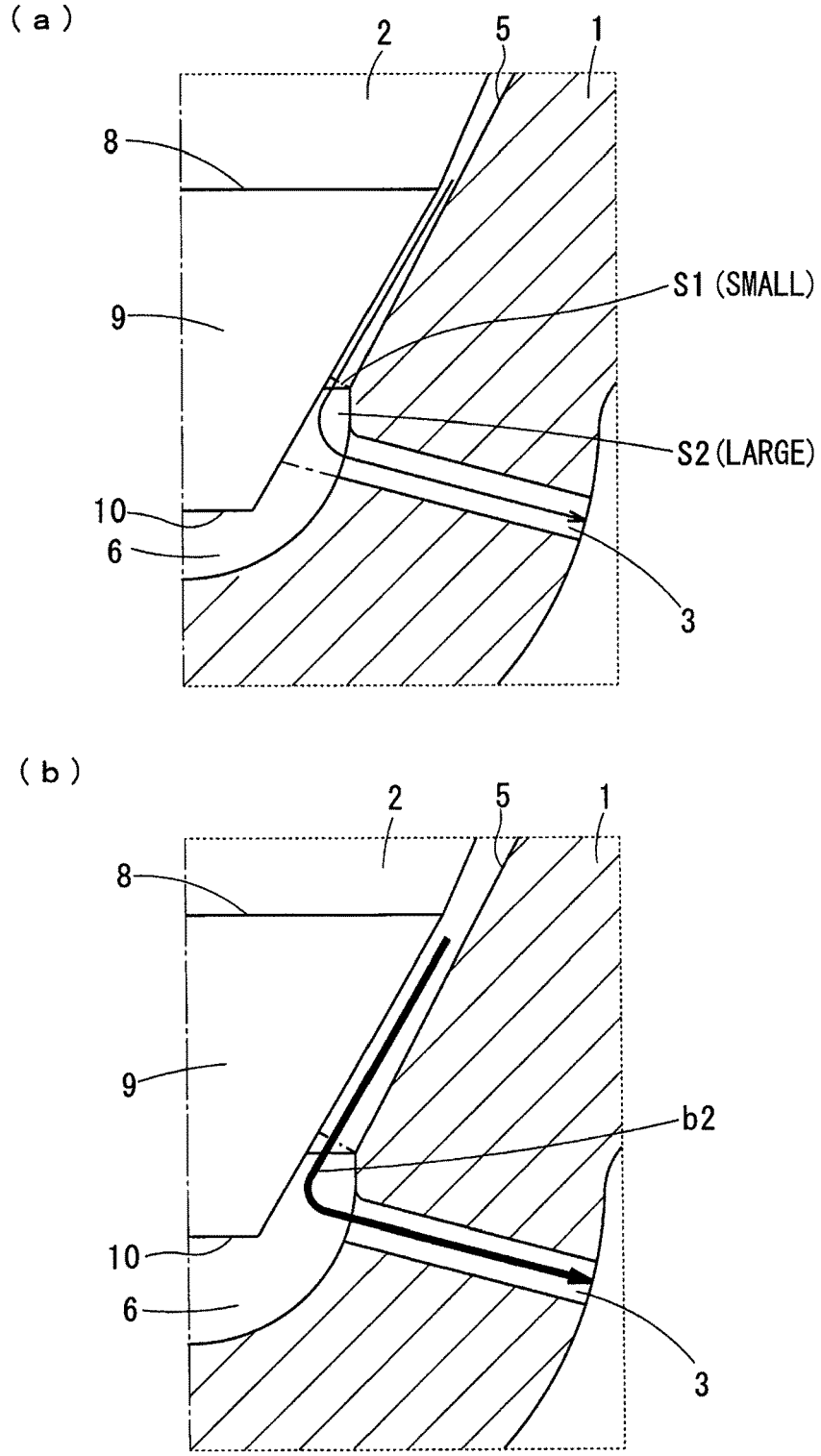
FIGS. 5A and 5B are views used to describe an operation in the case where the index value Sa is set to 0.5 or greater.

The fuel injection nozzle is of a conical insertion type. More specifically, a part of the conical portion 9 is inserted into the sac chamber 6. The conical portion 9 overlaps the sac chamber 6 in the axial direction h. That is, a relief portion 10 provided at a lower end of the conical portion 9 is located below a boundary line 11 between the valve seat 5 and the sac chamber 6. The shape of the relief portion 10 is not limited to any particular shape. As is shown in FIG. 2, the relief portion 10 may be formed in a shape of a flat surface perpendicular to the axial direction h. Different from the shape shown in FIG. 2, the relief portion 10 may be formed in a shape of a conical surface having a greater spread angle than that of the conical portion 9.

The following is a supplemental description of the conical insertion type. In a fuel injection nozzle of the conical insertion type, the relief portion 10 is located below the boundary line 11 when the seat portion 8 is seated on the valve seat 5, and the conical portion 9 and the sac chamber 6 overlap each other in the axial direction h. The conical portion 9 may overlap the sac chamber 6 in the axial direction h when the needle 2 is lifted to the maximum. Alternatively, the conical portion 9 may come out from the sac chamber 6 when the needle 2 is lifted to the maximum.

In a state where the needle 2 moves up and the seat portion 8 is not seated on the valve seat 5, a supply side of pressurized fuel is communicated with the injection holes 3, and fuel is injected from the injection holes 3. Conversely, in a state where the needle 2 moves down and the seat portion 8 is seated on the valve seat 5, the communication between the supply side of pressurized fuel and the injection holes 3 is blocked, and the injection of fuel is stopped.

The fuel injection nozzle of the present embodiment will now be described more specifically. The axial dimension of the cylindrical surface 6*a* is a sac length l. The diameter of the cylindrical surface 6*a* is a diameter dimension $\phi$ds. An axial straight line passing the center of the sac chamber 6, that is, an axial straight line passing the center of a cylinder forming the cylindrical surface 6*a* is a sac center line L1. A straight line drawn by extending the center axis of the injection hole 3 into the sac chamber 6 is an injection hole extended line L2. A location where the injection hole 3 opens in the sac chamber 6 is an injection hole inlet 3*a*. A straight line passing a lower end of the injection hole 3*a* and parallel to the injection hole extended line L2 is a lower end extended line L3.

In addition, the opening area of a throttle portion x defined between the upper end of the sac chamber 6 and the conical portion 9 is a throttle opening area S1. Half of an area surrounded by the throttle portion x, the needle 2, the inner wall of the sac chamber 6, and the lower end extended line L3 in the cross section of the sac chamber 6 taken along the sac center line L1 (see FIG. 1) is an injection hole upstream area S2. The passage area of the injection hole 3 is an injection hole area S3 (see FIG. 3A to FIG. 3C).

A lift amount of the needle 2, when the throttle opening area S1 is equal to an area calculated by multiplying the injection hole area S3 by the number of the injection holes 3, is a predetermined lift amount L. As has been described, the number of the injection holes 3 can be one. A viscosity coefficient of fuel is a coefficient ρ.

The throttle opening area S1 is an area that varies with the lift amount. More specifically, when the lift amount increases, the distance from the upper end of the sac chamber 6 to the conical portion 9 becomes greater. Consequently, the throttle opening area S1 becomes larger.

The injection hole upstream area S2 will now be described specifically. FIG. 1 shows a cross section of the sac chamber 6 taken along the sac center line L1. In the cross section of FIG. 1, the injection hole upstream area S2 is present on both sides across the sac center line. FIG. 2 shows half of the cross section of the sac chamber 6 shown in FIG. 1 when the cross section is divided to two along the sac center line. In the cross section shown in FIG. 2, the area surrounded by the throttle portion x, the needle 2, the inner wall of the sac chamber 6, and the lower end extended line L3 is the injection hole upstream area S2.

The fuel injection nozzle of the present embodiment is of a wide-angle injection type. In a fuel injection nozzle of the wide-angle injection type, an injection angle θ1 is set to a range from 60° to 85°. The specific example shown in FIG. 1 will now be described. The following will describe more specifically a configuration where two injection holes 3 oppose to each other through the sac center line L1 in between. That is, in a fuel injection nozzle of the wide-angle injection type, an angle formed between the injection hole extended line L2 of one injection hole 3 and the injection hole extended line L1 of the other injection hole 3 through the sac center line L2 is 120° to 170°.

In addition, as a specific example, the injection hole 3 is formed in such a manner that the injection extension line L2 becomes perpendicular to a line normal to the semispherical surface 6*b*. It should be appreciated, however, that the configuration of the injection hole 3 is not limited to the configuration as above.

A flow of fuel in the sac chamber 6 can be controlled by controlling the throttle opening area S1 and the injection hole upstream area S2. A flow rate coefficient in the sac chamber 6 is proportional to Equation (1) above. In the fuel injection nozzle of the present embodiment, an index value Sa calculated in accordance with Equation (3) as below satisfies an inequality of Sa≥0.5.

$$S_a = \frac{\rho}{2}\int_{h=0}^{h=L}\left(\frac{S_1}{S_2 - S_1}\right)^2 dh \qquad \text{[Equation 3]}$$

More specifically, the index value Sa is set to 0.5 or greater by increasing the diameter dimension ϕds and reducing the sac length l. A configuration for such setting will now be described more specifically. The throttle opening area S1 is increased by increasing the diameter dimension ϕds. Further, the injection hole upstream area S2 is reduced by reducing the sac length l. The index value Sa is thus set to 0.5 or greater.

In Equation (3) above, h=0 indicates an axial position of the needle 2 when an injection is stopped, and h=L indicates an axial position of the needle 2 when the lift amount reaches the predetermined lift amount L.

By referring to FIGS. 4A and 4B and FIGS. 5A and 5B, the following will compare operations in the case where the index value Sa is set to be less than 0.5 and in the case where the index value Sa is set to 0.5 or greater.

FIG. 4A shows an operation in a low lift state in the case where the index value Sa is set to be less than 0.5. When the throttle opening area S1 is small, fuel flowing into the sac chamber 6 gains a force. Accordingly, a strong turbulence develops in a flow of fuel in the sac chamber 6 and a flow rate coefficient in the sac chamber 6 is reduced.

FIG. 4B shows an operation in a high lift state in the case where the index value Sa is set to be less than 0.5. When the injection hole upstream area S2 is large, a flow b1 of fuel flowing into the sac chamber 6 changes to go along the inner wall of the sac chamber 6. Hence, a flow of fuel in the sac chamber 6 becomes unstable.

FIG. 5A shows an operation in a low lift state in the case where the index value Sa is set to 0.5 or greater. When the throttle opening area S1 is large, a force of fuel flowing into the sac chamber 6 can be weakened. Hence, a turbulence of fuel in the sac chamber 6 can be restricted, and a flow rate coefficient in the sac chamber 6 can be increased.

FIG. 5B shows an operation in a high lift state in the case where the index value Sa is set to 0.5 or greater.

When the injection hole upstream area S2 is small, a flow b2 of fuel flowing into the sac chamber 6 changes little. That is, a flow of fuel in the sac chamber 6 becomes stable.

First Effect of First Embodiment

As has been described, by setting the index value Sa calculated in accordance with Equation (3) above to 0.5 or greater, the flow rate coefficient in the sac chamber 6 can be increased. Further, a flow of fuel in the sac chamber 6 can be stabilized. Hence, the first embodiment can provide a fuel injection nozzle with a strong spray penetration force which remains steady even when a lift amount varies.

Second Effect of First Embodiment

By setting the index value Sa calculated in accordance with Equation (3) above to 0.5 or greater, the sac volume can be reduced. The sac volume is the volume between the nozzle body 1 and the needle 2 in the sac chamber 5. Owing to the capability of reducing the sac volume, fuel remaining in the sac chamber 6 after an injection is stopped can be reduced. Hence, the first embodiment can obtain an effect of reducing HO in an emission gas generated when fuel remaining in the sac chamber 6 leaks into the combustion chamber through the injection holes 3.

Other Embodiments

It should be appreciated that the present disclosure is not limited to the embodiment described above and embodiments as follows can be adopted as well.

In the embodiment above, the sac chamber 6 is formed by combining the cylindrical surface 6*a* and the semispherical surface 6*b*. It is noted that, a shape of the sac chamber 6 is not limited to the shape described above. More specifically, the cylindrical surface 6*a* may be in another shape or the semispherical surface 6*b* may be in another shape while maintaining the cylindrical surface 6*a* as it is.

The embodiment above has described the wide-angle injection type with an injection angle θ1 set to 60° to 85° as an example. It should be appreciated, however, that the injection angle θ1 is not limited to the range specified above. The injection angle θ1 may be set to be less than 60° or greater than 85°.

The embodiment above has described a case where the present disclosure is applied to a fuel injection nozzle used for a diesel engine. A diesel engine is a compression ignition internal combustion engine. Fuel injected from the fuel injection nozzle is not limited to light oil. Fuel injected from the fuel injection nozzle may be other types of fuel suitable for compression ignition, such as dimethyl ether.

The embodiment above has described a case where the present disclosure is applied to a fuel injection nozzle used for a diesel engine. It is noted that, the present disclosure may be applied to a fuel injection nozzle used for a gasoline engine.

The fuel injection nozzle may be of an all-around injection type configured to inject fuel all around the fuel injection nozzle. Alternatively, the fuel injection nozzle may be of a double-side injection type configured to inject fuel to both sides of the fuel injection nozzle. Further, the fuel injection nozzle may be of a one-side injection type configured to inject fuel to only one side of the fuel injection nozzle.

While the above has described the present disclosure according to the embodiments, it should be understood that the present disclosure is not limited to the embodiments and the structures described above. The present disclosure includes various modifications and alterations within the equivalent scope. In addition, various combinations and embodiments, as well as other combinations and embodiments further including one element alone and more or less than one element are also within the scope and the idea of the present disclosure.

The invention claimed is:

1. A fuel injection nozzle comprising:

a nozzle body having a valve seat, which is in a conical shape and formed inside the nozzle body, a sac chamber, which is formed inside the nozzle body to collect a pressurized fuel which has passed through an inside of the valve seat, and an injection hole to inject the pressurized fuel supplied to the sac chamber to an outside of the nozzle body; and a needle having a seat portion, which is to cut off a supply of the pressurized fuel into the sac chamber when seated on the valve seat, and a conical portion, which is in a conical shape with a boundary at the seat portion, the conical portion being inserted inside the sac chamber, the needle being driven in a linear direction inside the nozzle body, wherein the needle is to move in a direction upward when starting fuel injection, the needle is to move in a direction downward when stopping fuel injection, an upward movement amount of the needle is a lift amount, a direction along which the needle is to move is an axial direction, an axial straight line passing a center of the sac chamber is a sac center line, an opening area of a throttle portion defined between an upper end of the sac chamber and the conical portion is a throttle opening area S1, a straight line drawn by extending a center axis of the injection hole into the sac chamber is an injection hole extended line, a location where the injection hole opens in the sac chamber is an injection hole inlet, a straight line passing a lower end of the injection hole inlet and parallel to the injection hole extended line is a lower end extended line, a half of an area surrounded by the throttle portion, the needle, an inner wall of the sac chamber, and the lower end extended line in a cross section of the sac chamber taken along the sac center line is an injection hole upstream area S2, a passage area of the injection hole is an injection area S3, a lift amount, when the throttle opening area is equal to an area calculated by multiplying the injection hole area by the number of the injection hole, is a predetermined lift amount L, a viscosity coefficient of the pressurized fuel is a coefficient ρ, an index value Sa is calculated in accordance with an equation as below, and $$S_a = \frac{\rho}{2}\int_{h=0}^{h=L}\left(\frac{S_1}{S_2 - S_1}\right)^2 dh$$

the index value Sa satisfies an inequality of Sa≥0.5.

2. The fuel injection nozzle according to claim 1, wherein:

the sac chamber has a cylindrical surface, which extends downward from a lower end of the valve seat, and a hemispherical surface, which is formed at a lower end of the cylindrical surface.

3. The fuel injection nozzle according to claim 1, wherein:

an angle formed between a lower side of the sac center line and the injection hole extended line is set in a range from 60° to 85°.

* * * * *